US007467722B2

(12) United States Patent
Ramun

(10) Patent No.: US 7,467,722 B2
(45) Date of Patent: Dec. 23, 2008

(54) COUNTERWEIGHT FOR HEAVY EQUIPMENT

(76) Inventor: John R. Ramun, 8243 N. Lima Rd., Poland, OH (US) 44514

( * ) Notice: Subject to any disclaimer, the term of this patent is extended or adjusted under 35 U.S.C. 154(b) by 0 days.

(21) Appl. No.: 11/513,526

(22) Filed: Aug. 31, 2006

(65) Prior Publication Data

US 2008/0053944 A1 Mar. 6, 2008

(51) Int. Cl.
*B66C 23/74* (2006.01)

(52) U.S. Cl. ..... 212/178; 212/195

(58) Field of Classification Search ..... 212/178, 212/195

See application file for complete search history.

(56) References Cited

U.S. PATENT DOCUMENTS

| | | | | | |
|---|---|---|---|---|---|
| 2,522,742 | A | * | 9/1950 | Blackburn | 74/37 |
| 2,722,320 | A | * | 11/1955 | Dobeus et al. | 212/196 |
| 3,029,088 | A | * | 4/1962 | Loef | 280/62 |
| 3,032,352 | A | * | 5/1962 | Barrett | 280/759 |
| 3,492,019 | A | | 1/1970 | Folkerts | |
| 3,635,493 | A | | 1/1972 | Barth et al. | |
| 3,687,484 | A | * | 8/1972 | Cosby | 280/755 |
| 3,726,416 | A | * | 4/1973 | Pottorff et al. | 212/178 |
| 3,822,073 | A | | 7/1974 | Sieren | |
| 3,888,507 | A | * | 6/1975 | Berghausen | 280/759 |
| 3,902,735 | A | * | 9/1975 | Bertram et al. | 280/759 |
| 3,944,252 | A | | 3/1976 | Barth | |
| 4,232,883 | A | | 11/1980 | Bourgeous et al. | |
| 4,363,412 | A | * | 12/1982 | Patel et al. | 212/196 |
| 5,462,309 | A | | 10/1995 | Jeffers et al. | |
| 6,047,791 | A | * | 4/2000 | Hoebelheinrich | 187/222 |
| 6,296,436 | B1 | | 10/2001 | Ramun | |
| 6,481,748 | B1 | | 11/2002 | Okuda et al. | |
| 6,631,814 | B2 | * | 10/2003 | Willim | 212/178 |
| 2002/0076314 | A1 | * | 6/2002 | Zanetis et al. | 414/680 |
| 2005/0012314 | A1 | | 1/2005 | Kubo et al. | |

FOREIGN PATENT DOCUMENTS

| | | | |
|---|---|---|---|
| JP | 9-235754 | * | 9/1997 |
| JP | 2000-63082 | * | 2/2000 |
| JP | 2004-75312 | * | 8/2002 |
| WO | WO 79/01026 | | 11/1979 |

* cited by examiner

*Primary Examiner*—Thomas J. Brahan
(74) *Attorney, Agent, or Firm*—The Webb Law Firm

(57) ABSTRACT

An adjustable counterweight for use on construction vehicles that includes a body having a first section, a central section adjacent to the first section and a second section adjacent to the central section, wherein the first section and the second section each define a cavity therein. At least one weight plate, preferably a plurality of weight plates, is mounted in a predetermined position within each of the cavities and secured to the body of the counterweight. Each weight plate is shaped to fit the contour of each cavity, such that the amount of weight contained within each cavity is maximized.

13 Claims, 3 Drawing Sheets

COUNTERWEIGHT FOR HEAVY EQUIPMENT

BACKGROUND OF THE INVENTION

1. Field of the Invention

The present invention relates to counterweights and, more particularly, to an adjustable counterweight for use in construction vehicles.

2. Description of Related Art

Counterweights are used in construction machines such as hydraulic shovels and movable cranes to improve traction and stability by holding a front end of the machine more stable when using the mechanism on the front end (i.e., backhoe or crane) and during maneuvering of the machine. FIG. 1 shows a prior art counterweight 10 located in a rear end 14 of a construction vehicle 12. The counterweight 10 typically has a pre-determined weight and size depending on the size and weight of the construction vehicle. Generally, construction vehicles have a maximum load or weight limit that depends on both the size of the construction vehicle and the weight of the counterweight. The maximum load limit of the construction vehicle can be varied by varying the weight of the counterweight. In certain situations where space is limited (e.g., inside a factory or warehouse), it may be necessary to use a construction vehicle at or around its maximum weight limit. For example, it may be easier to use a small crane at or around its maximum load limit inside a warehouse or factory, than to use a larger crane and have to remove portions of a roof or relocate existing equipment in order to fit the larger crane. In this situation, it may be necessary to increase the weight of the counterweight thereby increasing the maximum load limit to stabilize further the crane during use. This can be accomplished by removing the existing counterweight from the back of the crane and replacing it with a larger and/or heavier counterweight. The purchasing, transporting and/or storing of additional counterweights not only increases the cost of the construction vehicle, but requires a large storage area for this additional piece of equipment.

Therefore, it is an object of the present invention to provide an adjustable weight plate arrangement adapted to mount within a prior art counterweight of a construction vehicle in order to increase the maximum weight limit of the construction vehicle.

SUMMARY OF THE INVENTION

The present invention provides for an adjustable counterweight for use on construction vehicles. The counterweight includes a body having a first section, a central section adjacent to the first section and a second section adjacent to the central section, wherein the first section and the second section each define a cavity therein. At least one weight plate, preferably a plurality of weight plates, are mounted in a predetermined position within each of the cavities and secured to the body of the counterweight. Each weight plate is shaped to fit the contour of each cavity, such that the amount of weight contained within each cavity is maximized.

The present invention also provides for a method of loading an adjustable counterweight onto a construction vehicle. The method includes providing a counterweight as discussed above and mounting at least one weight plate within each cavity of the body of the counterweight. Next, the weight plate is secured to the body via a bar passing through a hole in the weight plate and attached to the body. Lastly, the counterweight is attached to a construction vehicle.

DETAILED DESCRIPTION OF THE INVENTION

Figure 1:
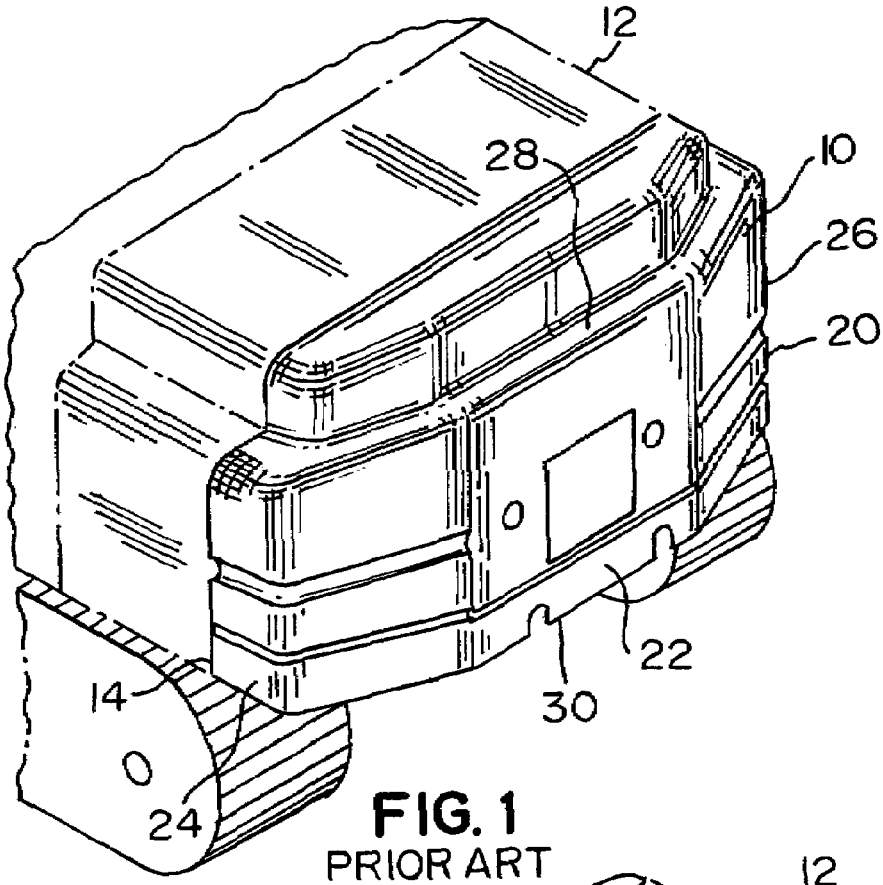
FIG. 1 PRIOR ART
FIG. 1 is a perspective view of a prior art counterweight mounted on a rear end of a construction vehicle.
Figure 2:
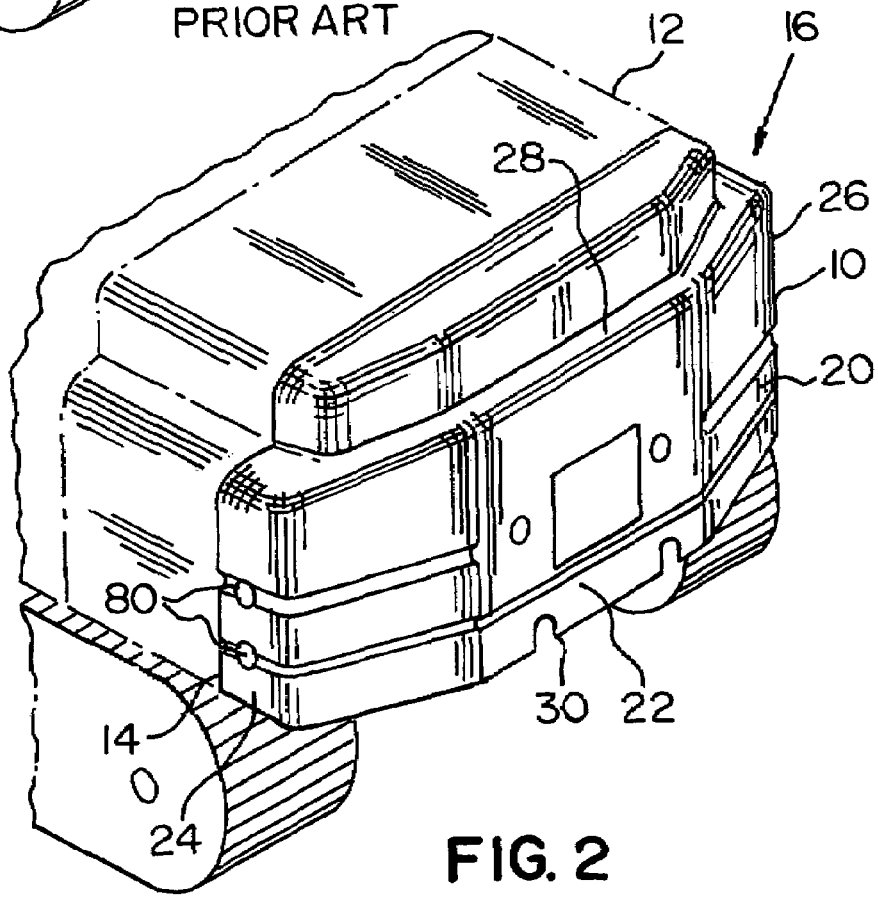
FIG. 2 is a perspective view of an adjustable counterweight according to the present invention mounted on a rear end of a construction vehicle.
Figure 3:
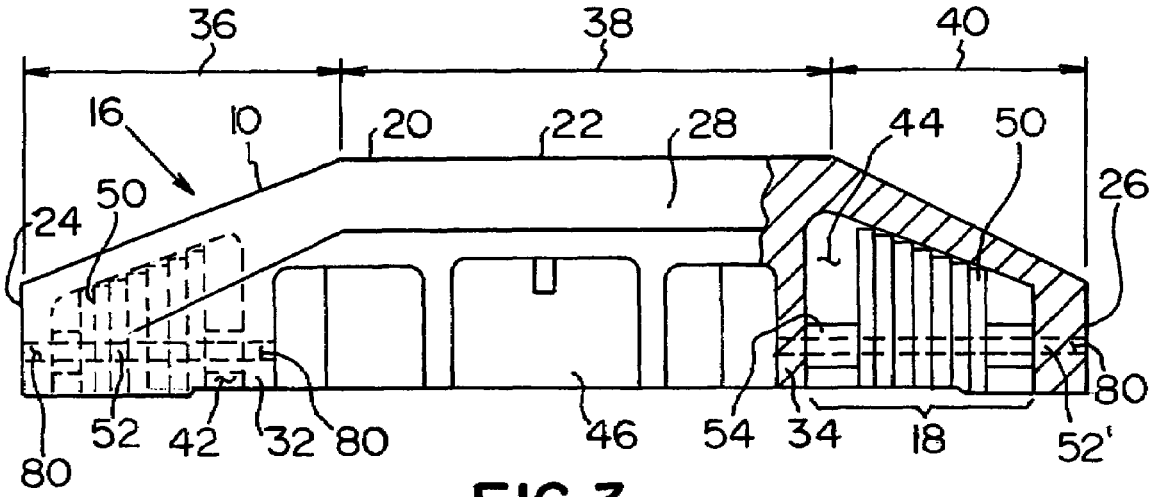
FIG. 3 is a top plan view, partially in section, of the adjustable counterweight shown in FIG. 2 having a weight plate arrangement mounted therein.
Figure 4:
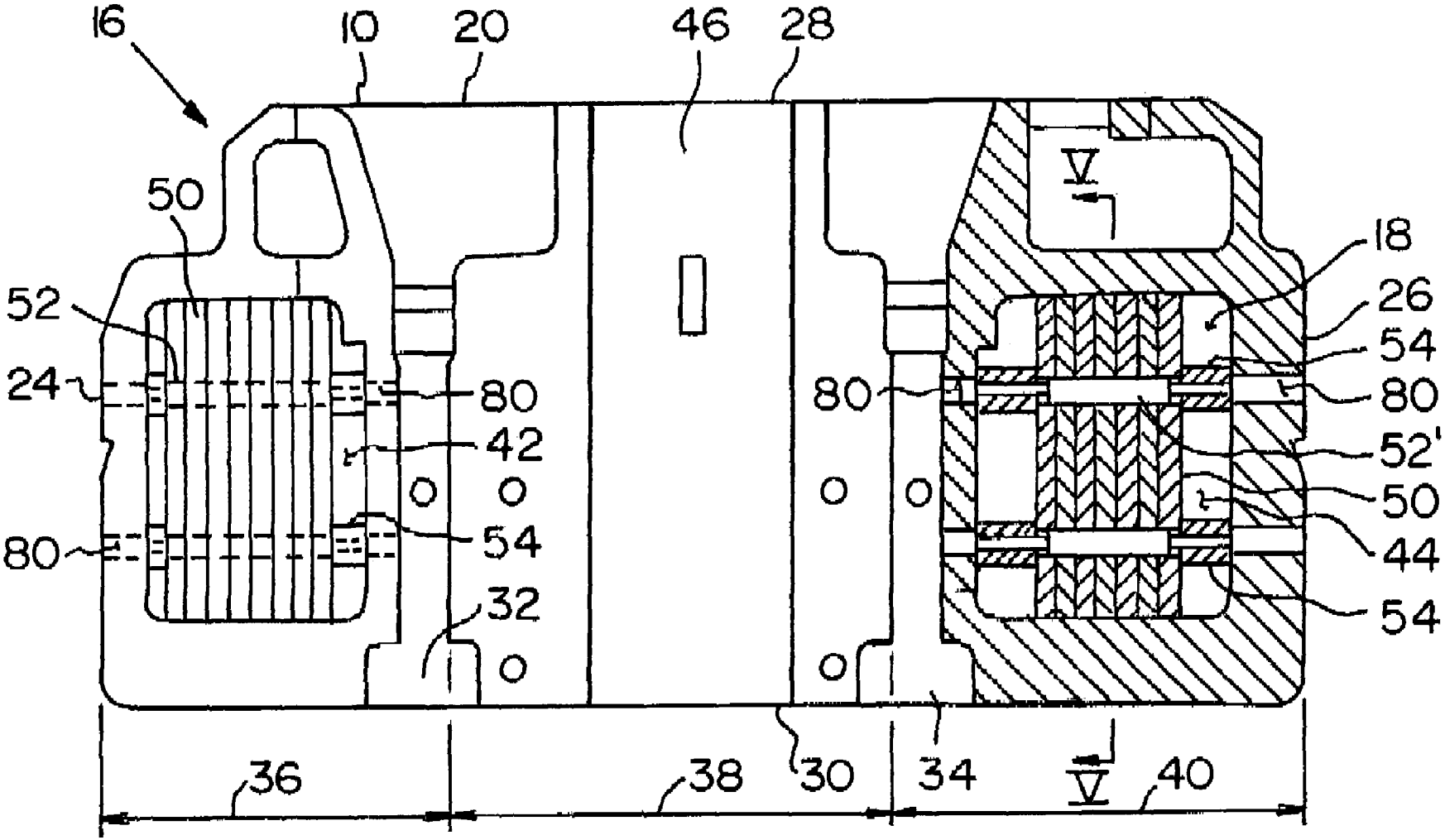
FIG. 4 is a front elevational view, partially in section, of the weight plate arrangement mounted within the adjustable counterweight shown in FIG. 3.

Referring to FIGS. 2-4, the present invention provides for an adjustable counterweight 16 adapted to mount on a rear end 14 of a construction vehicle 12 as shown in FIG. 2. The adjustable counterweight 16 includes the prior art counterweight 10 and a weight plate arrangement 18 mounted within the counterweight 10. Referring to FIGS. 3 and 4, the counterweight 10 includes a body 20 having a back wall 22, a first side wall 24, a second side wall 26, a top wall 28, a bottom wall 30, a first internal wall 32, and a second internal wall 34. The walls 22, 24, 26, 28, 30, 32 and 34 of the body 20 define a first section 36, a central section 38 adjacent to the first section 36 and a second section 40 adjacent to the central section 38.

With continued reference to FIGS. 3 and 4, the first section 36 of the body 20 is defined by the first side wall 24, the first internal wall 32 and a portion of the top wall 28, bottom wall 30 and back wall 22 and includes a first cavity 42 defined therein. The second section 40 of the body 20 is defined by the second side wall 26, the second internal wall 34 and a portion of the top wall 28, bottom wall 30 and back wall 22 and includes a second cavity 44 defined therein. The central section 38 of the body 20 is defined by the first internal wall 32, the second internal wall 34, a portion of the top wall 28, bottom wall 30 and back wall 22 and includes a weight part 46 made of a unitary piece of solid material. The prior art counterweight 10 having the spaced apart cavities 42, 44 without the weight plate arrangement 18 is generally of the type manufactured by Caterpillar Inc. The counterweight 10 is generally made of cast iron.

The counterweight 10 is adapted to receive a weight plate arrangement 18 within the cavities 42, 44 thus forming the adjustable counterweight 16 of the present invention. Because of the shape of the back wall 22, the first cavity 42 and the second cavity 44 of the body 20 of the counterweight 10 define an angled or curved profile (shown in FIG. 3). The angled profile of the first cavity 42 can be either substantially identical or different from the angled profile of the second cavity 44.

Figure 5:
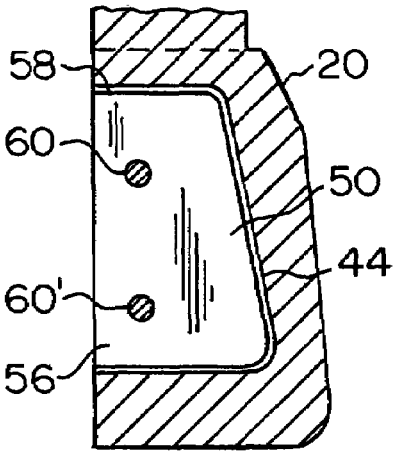
FIG. 5 is a sectional view of the adjustable counterweight shown in FIG. 4 taken along lines V-V.
Figure 6:
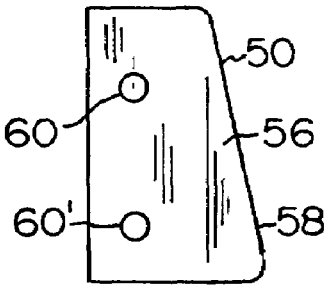
FIG. 6 is an elevational side view of a weight plate of the weight plate arrangement shown in FIG. 4.

Referring to FIGS. 3-6, the weight plate arrangement 18 includes a plurality of weight plates 50, bars 52, 52' for mounting the weight plates 50 within each of the cavities 42, 44 and a spacer 54 for securing the weight plates 50 to the body 20 of the counterweight 10. Referring to FIGS. 5 and 6, the weight plate 50 includes a body 56 defining a peripheral edge 58, wherein at least one hole 60 is defined in the body 56. The body 56 of the weight plate 50 preferably has two spaced apart holes 60, 60', wherein the holes 60, 60' are adapted to receive bars 52, 52', respectively. Each weight plate 50 of the weight plate arrangement 18 is shaped to fit the contours of the angled profile of the first cavity 42 and the second cavity 44 of the body 20 of the counterweight 10. Because of the angled profile of the cavities 42, 44, each of the weight plates 50 may have a different size and shape in order to utilize the entire space within the respective cavities 42, 44. The weight plates 50 may be made of metal, such as steel, and may have a weight ranging, for example, between 90 and 140 pounds per weight plate.

Figure 8:
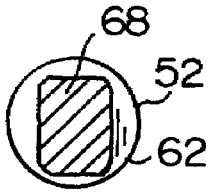
FIG. 8 is a sectional view of the bar shown in FIG. 7 taken along lines VIII-VIII.
Figure 9:
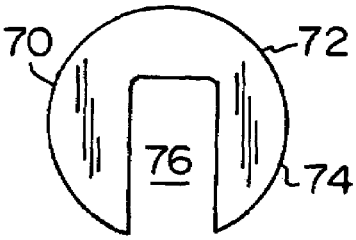
FIG. 9 is an elevational side view of a spacer used to secure the weight plate arrangement within the adjustable counterweight shown in FIG. 4.
Figure 10:
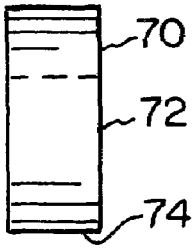
FIG. 10 is a front elevational view of the spacer shown in FIG. 9.
Figure 7:
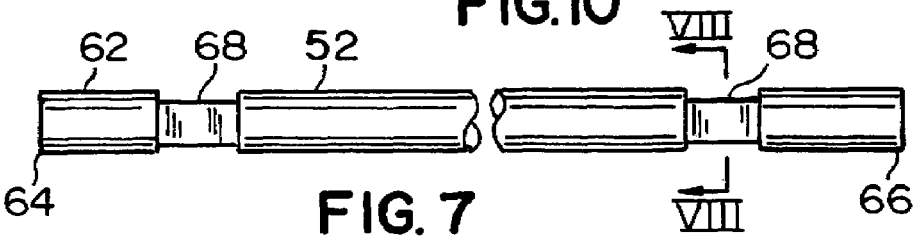
FIG. 7 is an elevational view of a bar used to mount the weight plate arrangement within the adjustable counterweight shown in FIG. 4.

Referring to FIGS. 7 and 8, the bar 52 is used to secure the weight plate arrangement 18 within each of the cavities 42, 44. The bar 52 includes a cylindrically shaped body 62 having a first end 64 and a second end 66 and defining a rectangular shaped receiving section 68 adjacent each end 64, 66 of the body 62 of the bar 52. The receiving section 68 is adapted to receive a spacer sleeve 70 (shown in FIGS. 9 and 10) for securing the weight plates 50 within the cavities 42, 44 of the counterweight 10. The bar 52 can be any length or diameter depending on the size of the counterweight 10 and the diameter of the holes 60 in the weight plate 50. Referring to FIGS. 9 and 10, the sleeve 70 includes a body 72 having a peripheral edge 74, wherein a slot 76 is defined in the body 72 and extends to the peripheral edge 74 thus defining a U-shaped cross section. Although the bar 52 has been described with a rectangular shaped receiving section and the sleeve 70 with a matching U-shaped cross section, other shapes are possible such that the shape of the slot 76 corresponds to the shape of the receiving section 68 of the bar 52 such that the spacer sleeve 70 is prevented from rotating when the slot 76 is received onto the receiving section 68 of the bar 52 (shown in FIG. 4).

Referring to FIGS. 2 and 4, an opening 80 is defined in the first side wall 24, the first internal wall 32, the second side wall. 26 and the second internal wall 34 of the body 20 of the counterweight 10 for receiving the bar 52. The number of holes in each weight plate 50 determines the number of openings 80 in each wall 24, 26, 32 and 34 of the body 20 of the counterweight 10. As shown in FIG. 4, the first side wall 24 and the first internal wall 32 each have two openings 80 for securing the weight plates 50 within the first cavity 42 via a bar 52 and spacer 54. The second side wall 26 and the second internal wall 34 also have two openings 80 for securing the weight plates 50 within the second cavity 44 via a bar 52 and spacer 54. The openings 80 in the counterweight 10 can be drilled or formed by any conventional methods known in the art.

In operation, the counterweight 10 is removed from a construction vehicle 12 such as with a hoist. Openings 80 corresponding to the number of holes 60 in the weight plate 50 are provided in the first section 36 (i.e., walls 24 and 32) and the second section 40 (i.e., walls 26 and 34) of the body 20 of the counterweight 10. The weight plates 50 are mounted adjacent to each other within each of the cavities 42, 44 in a predetermined order to utilize the most space within each of the cavities 42, 44. Weight plates 50 can be added or removed depending on the desired weight needed to stabilize further the construction vehicle 12 during use. The holes 60 in the weight plates 50 of the first cavity 42 are aligned with the openings 80 and a first bar 52 passes through the holes 60 in each weight plate 50 and the openings 80 in the counterweight 10. The holes 60 in the weight plates 50 of the second cavity 44 are aligned with the openings 80 and a second bar 52' passes through holes 60 in each weight plate 50 and the openings 80 in the counterweight 10. Preferably, two bars are used to secure the weight plates 50 within each of the cavities 42, 44. A spacer sleeve 70 defining a slot 76 is then placed on a receiving portion 68 of the bar 52, thereby restricting movement of the weight plates 50 within each of the cavities 42, 44. The spacer sleeve 70 also prevents the bar 52 from sliding out of the openings 80 in the body 20 of the counterweight 10. Lastly, the counterweight 10 is placed onto a rear end 14 of a construction vehicle 12 (shown in FIG. 2). Because the spacer sleeve 70 secures the weight plate arrangement 18 within the cavities 42, 44, there is no need for attaching the bar 52 to the body 20 of the counterweight 10 via welding or other mechanical fastening means known in the art. This arrangement enables the weight plate arrangement 18 to be removably secured to the body 20 of the counterweight 10 thus making the removal and addition of weight plates 50 easier.

This invention has been described with reference to the preferred embodiments. Obvious modifications and alterations will occur to others upon reading and understanding the preceding detailed description. It is intended that the invention be construed as including all such modifications and alterations.

The invention claimed is:

1. An adjustable counterweight for use in construction equipment, said counterweight comprising:

a body having a first section, a central section and a second section, said first section horizontally adjacent to said central section which is horizontally adjacent to said second section, said first section defines a first cavity therein and said second section defines a second cavity therein; and at least two weight plates defined within each of the cavities of said first section and said second section, wherein each weight plate within each cavity is removably secured to said body of said counterweight on a bar and is horizontally disposed along said bar relative to other plates in each cavity, wherein each weight plate comprises a body having a peripheral edge and defining a hole spaced from the peripheral edge of said body, the hole is adapted to receive said bar for securing each weight plate to said body of said counterweight.

2. The adjustable counterweight as claimed in claim 1, wherein a plurality of holes is defined in said body of each weight plate for securing each weight plate to said body of said counterweight.

3. The adjustable counterweight as claimed in claim 1, wherein said body of said counterweight is made of a unitary piece of solid material.

4. The adjustable counterweight as claimed in claim 1, wherein the first cavity and the second cavity comprise angled or curved profiles.

5. The adjustable counterweight as claimed in claim 4, wherein each adjacent weight plate is shaped to fit the contour of the angled profile of the first cavity and the second cavity of said body of said counterweight.

6. The adjustable counterweight as claimed in claim 5, wherein each weight plate within the first cavity has a different size and shape, and each weight plate within the second cavity has a different size and shape.

7. The adjustable counterweight as claimed in claim 1, wherein said bar passes through the hole in each weight plate and attaches to said body of said counterweight.

8. The adjustable counterweight as claimed in claim 7, wherein said body of said counterweight defines a plurality of openings therein, wherein said bar passes through the openings for attaching said bar to said body of said counterweight.

9. The adjustable counterweight as claimed in claim 8, wherein said bar comprises a receiving portion, said counterweight further comprising a spacer sleeve adapted to fit onto said receiving portion of said bar thereby restricting axial movement of each weight plate along the bar within each of the cavities of said body of said counterweight.

10. The adjustable counterweight as claimed in claim 9, wherein a spacer sleeve defines a slot therein, said spacer sleeve is adapted to abut against each weight plate when the slot is received on said receiving portion of said bar.

11. The adjustable counterweight as claimed in claim 10, wherein said receiving portion of said bar corresponds to the shape of the slot of said sleeve such that the rotation of said spacer sleeve is prevented when said spacer sleeve is received onto said receiving portion of said bar.

12. An adjustable counterweight in combination with construction equipment having a body with a revolving superstructure thereon, and the counterweight placed in the rear of the revolving superstructure, the counterweight comprising a body having a first section, a central section horizontally adjacent to said first section, and a second section horizontally adjacent to said central section, said first section and said second section each define a cavity therein; and at least two weight plates defined within each of the cavities of said first section and said second section, wherein each weight plate within each cavity is removably secured to said body of said counterweight on a bar and is horizontally disposed along said bar relative to other plates in each cavity, wherein each weight plate comprises a body having a peripheral edge and defining a hole spaced from the peripheral edge of said body, the hole is adapted to receive said bar for securing each weight plate to said body of said counterweight.

13. A method of loading an adjustable counterweight onto a construction vehicle, said method comprising:

a) providing a counterweight comprising a body having a first section, a central section and a second section, said first section horizontally adjacent to said central section, said second section horizontally adjacent to said central section, said first section and said second section each define a cavity;

b) mounting at least two weight plates within each cavity of said first section and said second section of said body, each weight plate comprises a body having a peripheral edge and defining a hole spaced from the peripheral edge of said body, wherein each weight plate is positioned along a bar and is horizontally disposed along said bar relative to other plates;

c) securing each weight plate to said body via said bar passing through the hole in each weight plate and attached to said body of said counterweight; and d) attaching said counterweight to a construction vehicle.

* * * * *